US007465060B2

(12) United States Patent
Opolka

(10) Patent No.: US 7,465,060 B2
(45) Date of Patent: Dec. 16, 2008

(54) PACKAGING OR SUPPORT FOR A LAMP

(75) Inventor: Rainer Opolka, Solingen (DE)

(73) Assignee: Zweibruder Optoelectronics GmbH, Solingen (DE)

( * ) Notice: Subject to any disclaimer, the term of this patent is extended or adjusted under 35 U.S.C. 154(b) by 7 days.

(21) Appl. No.: 10/594,828

(22) PCT Filed: Mar. 17, 2005

(86) PCT No.: PCT/DE2005/000481

§ 371 (c)(1),
(2), (4) Date: Sep. 28, 2006

(87) PCT Pub. No.: WO2005/097619

PCT Pub. Date: Oct. 20, 2005

(65) Prior Publication Data

US 2007/0206385 A1 Sep. 6, 2007

(30) Foreign Application Priority Data

Apr. 5, 2004 (DE) ..... 20 2004 005 576 U
Oct. 13, 2004 (DE) ..... 20 2004 015 802 U
Nov. 12, 2004 (DE) ..... 20 2004 017 571 U

(51) Int. Cl.
*F21L 4/00* (2006.01)

(52) U.S. Cl. ..... 362/189; 362/205; 362/208

(58) Field of Classification Search ..... 362/186, 362/189, 190, 191, 200, 201, 205, 206, 208, 362/295, 394
See application file for complete search history.

(56) References Cited

U.S. PATENT DOCUMENTS

| | | | | | |
|---|---|---|---|---|---|
| 2,587,223 | A * | 2/1952 | Robinson | 362/201 |
| 2,614,206 | A * | 10/1952 | Goad | 362/191 |
| 2,772,349 | A * | 11/1956 | Chamberlin | 362/201 |
| 3,042,796 | A * | 7/1962 | Forest | 362/158 |
| 4,542,447 | A * | 9/1985 | Quakenbush | 362/200 |
| 5,927,846 | A * | 7/1999 | Sinclair | 362/189 |
| 7,392,906 | B2 * | 7/2008 | Yu | 206/471 |
| 2007/0017402 | A1 * | 1/2007 | Dalton et al. | 362/208 |

* cited by examiner

*Primary Examiner*—Y My Quach Lee
(74) *Attorney, Agent, or Firm*—Andrew Wilford

(57) ABSTRACT

A flashlight has a housing, a battery in the housing, a light source on the housing, and a circuit between the battery and the light source and including a switch actuatable to energize the light source. A package encloses the flashlight and holds an externally actuatable package switch separate from the housing switch and carried on the packaging material and wiring connected between the package switch and the circuit of the flashlight such that the package switch is actuatable to energize the light source. The wiring is releasably connected to the circuit for disconnection of the wiring and package switch from the circuit on separation of the flashlight from the package.

13 Claims, 8 Drawing Sheets

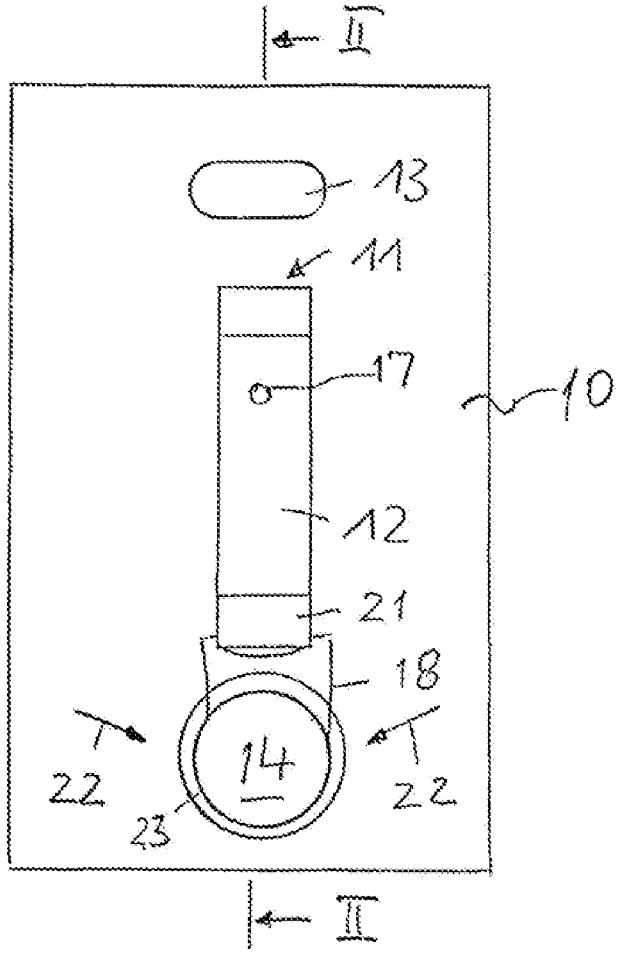
Fig. 1
Fig. 2
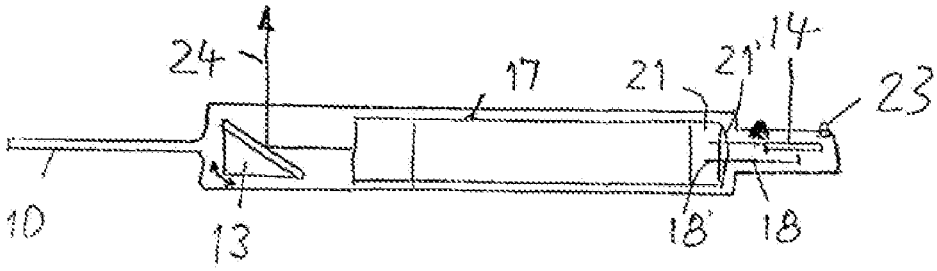

PACKAGING OR SUPPORT FOR A LAMP

CROSS REFERENCE TO RELATED APPLICATIONS

This application is the U.S. national phase of PCT application PCT/DE2005/000481, filed 17 Mar. 2005, published 20 Oct. 2005 as WO 2005/097619, and claiming the priority of German patent application 202004005576.7 itself filed 5 Apr. 2004, German patent application 202004015802.7 itself filed 13 Oct. 2004, and German patent application 202004017571.1 itself filed 12 Nov. 2004 whose entire disclosures are herewith incorporated by reference.

FIELD OF THE INVENTION

The invention relates to a package or a holder with a pocket or a fastening means for a lamp, in particular for a battery-operated flashlight.

BACKGROUND OF THE INVENTION

Products that are commercially distributed need packaging for protection against damage during transport and/or during storage. The smaller the commercial products are, the greater the requirement of designing the package such that it is theft-resistant, which requires that on the one hand the packaged pieces cannot easily be removed from the package or the holder and on the other hand that the size of the package avoids as far as possible hiding of the package and its contents. Moreover, in such a package or on outside of the package space can be used for information about the product, the manufacturer, etc.

Packages that have the above-mentioned properties are known as so-called blister packages in the prior art. Such blister packages generally consist of one or two plastic parts, that has or have a bubble that encloses the product. Using a transparent foil, these pieces can also be attached to a cardboard sheet that carries an imprint with the above-mentioned information and/or has a punching the contours of which approximately corresponds to the overall dimensions of the piece that is held in the packaging, if necessary, further tongues or other undercuts additionally enabling a fastening of the products in the transparent foil packaging. The cardboard pieces are often also designated as so-called view cards, that often have a slit or another opening that is destined to facilitate hanging on a projecting rod of a display.

In packages of battery-operated lamps, in particular flashlights, the particularity exists that in a package, as far as it is theft-resistant as described, functional control of the lamp is only possible after opening the package. Often, shops insist that opening packages obliges one to purchase, which can under certain circumstances prevent customers from selecting a specific product because the exchange procedure is feared.

For about three years, more and more flashlights have appeared on the market that are provided with one or more light-emitting-diodes (LED). LEDs have in comparison with incandescent lamps the advantage of a considerably higher shelf life as well as lower power consumption. The light emitted by light-emitting diodes can be blue, orange, red or even white (according to the selected light-emitting-diode), which increases the attraction for the customer to get to know the luminescent color before purchase. Furthermore, for the purchase decision, besides the color, also the luminosity of the flashlight as well as the angle of radiation are important. Beside functional control, the optical design of the package and/or the view card is part of a purchase decision. In particular if the products such as the miniature flashlights of the competitors are relatively similar and provided with comparable equipment, additional sales inducements play a major role.

OBJECT OF THE INVENTION

It is therefore an object of the present invention to improve a package and/or card of the type cited at the beginning such that a possibility can be created to control the function of the lamp without damaging the package.

SUMMARY OF THE INVENTION

This object is solved by the package or the holder wherein in order to be able to switch the lamp on or off, principally two possibilities exist. According to a first embodiment, the on/off switch of the inserted flashlight is freely accessible, i.e. the blister package has a hole at the place where the light switch is situated. The light switch should however be slightly recessed in comparison to the edge of this opening, to avoid unintentional switching on of the lamp during transport or in storage. However, it must be assured that the light switch is easily accessible with a finger tip or a finger nail, or if necessary, with a pin-shaped object.

According to an alternative embodiment, an external switch that is separate from the packaged lamp is provided on the package or on the holder and that is part of an electric circuit with wiring in the package or mounted on the holder that also contains the lamp battery and the light source. This variant has the advantage that the on/off switch that is to be actuated for functional control can be mounted such that it is easily accessible on the packaging, in particular this switch can be designed with a large surface that facilitates operation. This switch is provided in an electric circuit that bypasses the circuit path belonging to the lamp itself such that closing of the electric circuit can be achieved either by closing the external switch or the internal switch of the lamp. In principle, it is also possible to electrically connect in series the internal and external switch of the lamp, but however it must be assured that after removing the lamp from the package, the external switch or a corresponding bypassing path always remains closed. The external switch on the package or on the holder offers the customer the possibility of functional control of the lamp, so that the luminosity (and thus, if necessary the state of charge of the battery) as well as the color of the light emitted by the diode and finally the angle of radiation can be seen. Hence, the customer can make sure by testing before the purchase if he has made a satisfying choice. Similarly, it is e.g. possible at the cash point of the department store to easily test a lamp that is still packaged so that subsequent complaints can be avoided or rejected, e.g. if these concern missing or not charged batteries, other missing parts or malfunctions. In particular, in the case of similar or even identical products the choice of the customer is facilitated or promoted when he can see in use, by switching on the lamp, what he purchases.

After the purchase of the lamp and the removal of the lamp from the blister package, the electric circuit path that bypasses the switch of the lamp is removed, which can be realized by means of different possibilities that will be described later, such that the ease of operation or handling is not restricted. The external switch as well as the electric circuit remain on the package or in the package or the holder and can easily be disposed of.

Preferably, the external switch is provided in the package or on the holder such that it lies in a cavity. In particular it is advantageous if around the switch is provided a raised bead of the package or the holder, by means of which an unintentional pushing down of the switch is avoided during stacking, storage, or transport. Preferably, the external switch is a momentary-contact pushbutton on the package or the holder, which only closes the electric circuit as long as the momentary-contact pushbutton switch is pressed. This way, it is assured that the lamp is switched on only temporarily during a short time.

As already mentioned, the switch that is external to the lamp is provided in wiring that electrically bypasses the switch of the lamp as a parallel circuit. Preferably, the wiring ends of this parallel line with the external switch are attached via break points to the electric circuit of the flashlight, the break points being provided preferably in or on the housing of the flashlight.

Conventional flashlights are supplied by means of a low-voltage source that mostly consists of one or more batteries. According to the light source, which is preferably an LED, three or four button batteries are sufficient that are inserted into a battery compartment that is closed via a lid on the back side. The electric circuit is created on the one hand via contacts or springs inside the lamp and on the other hand via the lamp housing itself, this electric circuit being provided with the switch for opening and closing the electric circuit. The conductive path that is parallel to the switch of the lamp can be bypassed, can be connected via solder points to the electric circuit of the lamp. As long as the lamp remains in the package, the solder points are not exposed to mechanical load or chemical influences, since external forces are resisted by the package itself or the holder on or in which the lamp is provided. Corrosion (oxidation) on the solder points is avoided by the closed design of the package. Preferably, the package or the holder is designed such that when the lamp is unpacked, the parallel wiring connection breaks off at the break points so that without additional work the lamp is immediately functional after removal from the package.

Alternatively, it is of course also possible to provide a lamp in the package with a cap shaped lid that is made from non-conducting material that closes the battery compartment and that is removably screwed onto the flashlight case on its back side. This lid holds the wires or contacts for the external switch. In this embodiment, the internal switch of the lamp remains permanently closed, while the external switch is electrically connected in series and is designed as a momentary-contact pushbutton switch, such that the lamp can only be switched on by pressing this switch. After purchase of the lamp or removal of the lamp from the package, the cap that is made from a non-conducting material, in particular plastic material, is screwed off and replaced by a common metal cap.

According to another design, it is possible to provide a jack on the flashlight in which a plug can be inserted. This plug is in turn connected to a switch, in particular a momentary-contact pushbutton on the holder or in the package, which enables switching on/off of the packaged lamp. In this case, the corresponding wiring is also electrically parallel to the internal switch of the lamp.

In particular in flashlights that recently appeared on the market with one or more light-emitting diodes that emit light in different colors and luminosities, the need is of not only controlling the functioning of this lamp but also of testing the emission spectrum of the used LED. Thus, it is a design object of the package that the function of the lamp can be controlled without damaging the package. The free accessibility of the pressure switch of the flashlight can lead to the fact that the lamp is switched on, but however is not switched off again in case of lack of positive purchase decision. Also incorrect ways of handling of this kind cannot be excluded, which can lead to the fact that the flashlight remains switched on in an uncontrolled manner during a longer time and accordingly the battery capacity is consumed.

This can be avoided in the second solution by means of an external separate switch that is designed as a momentary-contact pushbutton switch, since the momentary-contact pushbutton switch only switches on the light source (LED) as long as the momentary-contact pushbutton switch is pressed. However, such packages are relatively complicated and their fabrication is more expensive than common blister packages. Furthermore, in these packages it must be assured that the wiring that is integrated in the package can be removed by the customer after the purchase of the product that for example can be realized by means of a break point.

As an alternative solution, a pressure element is provided that consists of an elastic spring body that is movable by external actuation against a spring force. When moved against such spring force, the pressure switch first moves through a position closing the circuit, but does not lock. Thus, the present package has the following advantages: On the one hand, the battery-operated flashlight does not have to be removed from the package for the testing. On the other hand, the spring element protects in an easy and efficient manner against permanent switching on, since by actuating the spring element, only the pushbutton function of the flashlight can be activated. The spring element thus blocks locking of the pressure switch for permanent switching on of the flashlight. The spring element according to the invention is connected to the flashlight, but not obligatorily, such that the flashlight can be removed from the package independently from the spring element and can be used immediately. Finally, such spring element is inexpensive to make and possibly can be reused, at least can be recycled.

Further embodiments of the invention are described in the following. Thus, the elastic spring body at its simplest can consist of a shaped leaf spring having legs that are in the relaxed state oriented at a small acute to each other and can be moved together against the spring tension, preferably until touching each other. The mentioned state of touching each other thus determines the maximum possible spring travel, which can be used in practice so that the pressure switch is not able under any circumstances to be set in the locked position. Such leaf-spring element can also be fabricated in an inexpensive manner from relatively cheap spring steel.

According to another design of the present invention, the shaped leaf spring is designed such that it extends in the flashlight over a circular angle of more than 180° C., preferably of more than 270° C., the leaf spring in the relaxed state not touching the pressure switch. Preferably the spring body lies loosely in the package, or is attached to the package with at least one leg. The loose insertion of the leaf spring in the package also includes such embodiments in which the leaf spring is fixed in a corresponding recess, so that longitudinal axial displacement of this spring element is avoided. This can also be achieved by a possible anchoring of an end of the spring body.

The package material consists according to a further design of the invention of flexible plastic material, preferably in the form of a transparent blister package. On a view card or imprinted on the package may be found information concerning the content of the package—here, the flashlight—as well as indications, at which point the package must be pressed to actuate the spring element to activate the pushbutton function of the pressure switch.

The lamp or flashlight possesses a pressure switch that is known in the prior art for switching on and off, that can be moved over into a first position into a contact closure in a closed electric circuit and that only locks when further pushed into a second position and fixes the contact closure and interrupts the contact closure when pressed again. By means of an external traction or pressure element that can be actuated for movement of the pressure switch into the first position, the momentary functional control of the lamp, in particular of the flashlight, can be conducted according to the invention. As herein only the pushbutton function is used, the lamp is only on as long as the external traction or pressure element is actuated by the customer. The arrangement according to the invention can easily be realized and has the advantage that the lamp can be removed from the packing and be used without a need for detachable connections. The external traction or pressure element is designed as a cheap piece and can be part of the disposable package or be added to the recyclable garbage.

Further embodiments of the invention are described in the following.

Thus, the traction element can consist in a simple manner of a cord, the first end of which is connected to the lamp or at the package or the holder. The cord passes over the pressure switch or engages it, its second free end projecting out of the package. If this cord is pulled, the pressure switch is depressed for contact closure (without locking). By releasing the cord, the pressure switch moves back into the initial position as a result of its spring biasing. If necessary, the pressure switch can be provided such that the point where the pressure switch locks is definitely below the flashlight surface that surrounds the switch.

Alternatively, the pressure element can also be a lever that is preferably a one-arm lever with a pivot on the lamp or on the package or the holder. The other end of the lever is either freely accessible from outside the package or is connected to a traction or pressure element so as to be being able to pivot the lever. In principle the actuation of the pressure switch is generally as described above for the cord.

In a particular design, the first end of the lever can be attached to the lamp or the package or the holder, the central part of the lever can pass over the pressure switch or engage it, and the second end can be connected to a traction means or a cord or a pull rod that is extends outward and thus can be operated externally. In this embodiment, the one-armed lever is relatively short.

In a further embodiment, the pressure element is a rod that extends outward and acts on a leaf spring that engages the pressure switch. This embodiment has the advantage in comparison with a rod that acts immediately on the pressure switch that via the spring travel, the leaf spring of the actuating way of the pressure switch can be limited, so that it can only be moved downward so far that it does not lock. The maximum spring travel of the leaf spring thus serves as a limit or stop for a pressure actuation rod.

To create an additional sales inducement, in front of the light output opening of the lamp, there is a body that reflects, deviates, refracts and/or disperses the exiting light beam.

This body can preferably be a mirror, a prism of a transparent material or an optical waveguide, preferably the package being designed as a blister package, in particular with an inserted view card.

The would-be purchaser of such a battery-operated lamp is induced to switch on the lamp, and he is surprised by the reflection, deviation, reflection and dispersion of the light. For example, the mirror or a deviating prism can be oriented such that the exiting light beams are reflected or deviated vertical to the package surface, so that the viewer an immediate impression of luminosity. Of course, such light deviation cannot be used for radiation that harms the eyes as for example from a laser.

The body can also be a double mirror or a combination of multiple deviating prisms, lenses etc. In one package, for example on a dark view card can be formed a moving beam that can be followed with the eye. If according to a further preferable design the mirror or another element is provided such that it can be pivoted in the package or on the holder or on an inserted view card, possibly also different refractions, reflections etc. can be generated. Beside the reflection or the deviation, also spectral shifts of the emitted light can be achieved, such that a light that is emitted substantially as white light is split into different primary colors. An optical waveguide, into which the irradiated light is transmitted via total reflection, can achieve corresponding to the arrangement of the optical waveguide an oriented light deviation. As is known from decorative lamps for residential use, the optical waveguide can also possess a transparent external envelope so that the corresponding cable or the wiring is clearly visible for the viewer. Possibly, with such package design, an effect can be achieved that practically provokes radiation of the total of the package surface, if necessary in combination with additional color effects that are caused by light refraction or dispersion. This also includes embodiments in which fluorescent pigments or the like are enclosed in the existing prism or other transparent material.

When the body is provided such that it can be pivoted according to another design of the invention in the package, on the holder or on an inserted view card, the plurality of optical representation methods can still be increased. Such a package not only stimulates the customer's interest, but also increases the purchase inducement, the more so as also the package with the inserted lamp represents a fancy present, in particular also for the advertising industry where the package itself or view card can be used for sales messages.

Ideally, the package is designed as a blister package, preferably with an inserted view card, resulting in an optimal light transparency as well as the best possible theft protection.

BRIEF DESCRIPTION OF THE DRAWING

Further details and advantages of the invention will be discussed on the basis of the drawings. Therein, FIG. 1 is a diagrammatic top view of a package holding a flashlight, FIG. 2 is a cross-sectional view taken along line II-II through the package according to FIG. 1, FIG. 3 as well as FIG. 4 are schematics for a connection in parallel and in series of the internal and external switches of the lamp.

SPECIFIC DESCRIPTION

Figure 3:
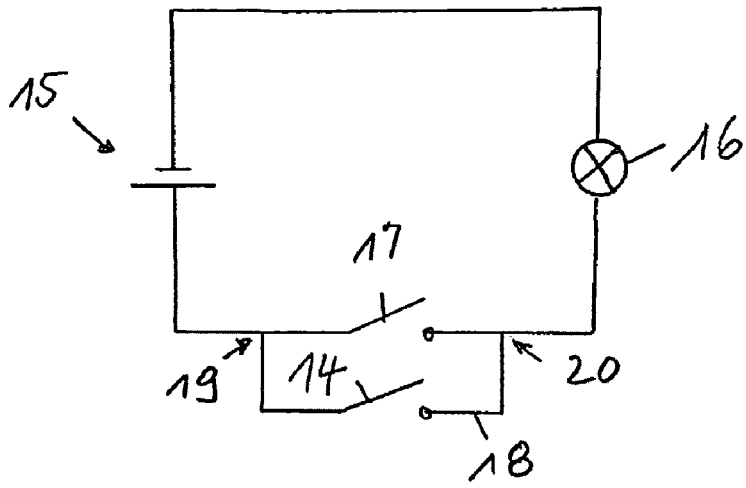

The package that is represented diagrammatically in FIGS. 1 and 2 is preferably a blister package from a transparent, relatively rigid plastic material made from PVC or PE. The package for example consists of two package halves that are made by injection, forming or vacuum forming. At least one package half, if necessary both package halves, can be provided with a product pocket, whose edges are aligned with each other when connected together. By means of engaging undercuts, welds, bonds or the like, the package halves can be fixed to each other such that the inserted product is only accessible by cutting open or destroying the package. The same thing is applied for holders on which the product is held via fasteners and, if necessary, covered by foils. At least in the area of the lamp head, the foils or package parts used are transparent.

According to the invention, in the package 10 a body 13 that can most simply be a mirror or a prism is provided in front of a light output opening 11 of the lamp 12. As shown in FIG. 2, the light is reflected via the mirror 13, as indicated by arrow 14, so that the person who switches on the lamp in the packaged state can make sure the lamp works.

Figure 4:
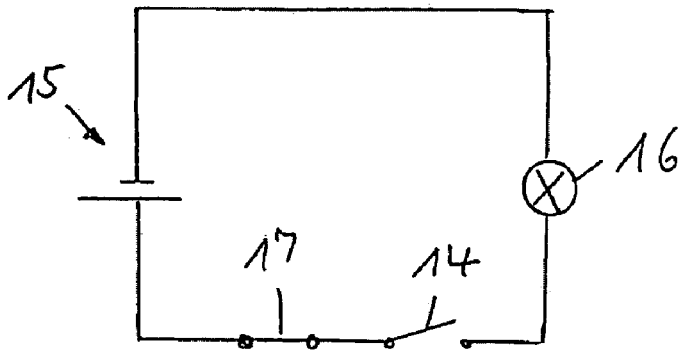

In addition, a switch 14 that is designed as a momentary-contact pushbutton switch is provided on the package outside the lamp and via which the lamp 12 can be switched on. The electric circuits and the circuit possibilities can be seen in principle in FIGS. 3 and 4, in which a battery 15 as well as light source 16 in an electric circuit with a switch 17 can be seen. The switch 17 is the on/off switch that is provided for example on the cylindrical housing of the flashlight. This switch 17 can also be designed as an end pushbutton switch or rotary switch. The switch 14 is provided in a parallel line 18 that extends through a plug 18' and a socket 21' (FIG. 2) and bypasses the switch of the lamp 17. The connecting points 19 and 20 of the wire 18 with the electric circuit of the lamp can in particular be designed as break points that are disconnected on removal of the flashlight from the package 10. Alternatively, also a circuit variant according to FIG. 4 is possible in which the switches 14 and 17 are connected in series, the flashlight 12 being inserted with a closed switch 17 into the package 10. By pushing the momentary-contact pushbutton switch 14, the electric circuit is closed.

The variant according to FIG. 4 however presupposes that after removal of the switch 14 the electric circuit it is in is closed. This can be done by making the lid 21 of the lamp that closes the battery compartment from a non-conducting material, in particular a plastic material, and providing in it slots or bores for the wiring to the switch 14. This lid is taken off after removal from the package and replaced by a metallic lid that is also contained in the package.

The package or the card itself can also contain, in addition to product-specific information such as indications concerning the luminosity, the power supply, the used light sources or other indications, indications concerning the functional control for the lamp as indicated schematically by arrows 22. The eventual customer can, by pressing the switch 14, switch on the lamp in the packaged state and thus perform a function and effect control on it. For protecting the momentary-contact pushbutton switch 14 against unintentional activation in the case of stacking or other storage of multiple packages 10, the momentary-contact pushbutton switch 14 is provided in a cavity that is totally surrounded by a bead 23 that is substantially circular. This bead 23 is part of the package or the card.

Figure 5:
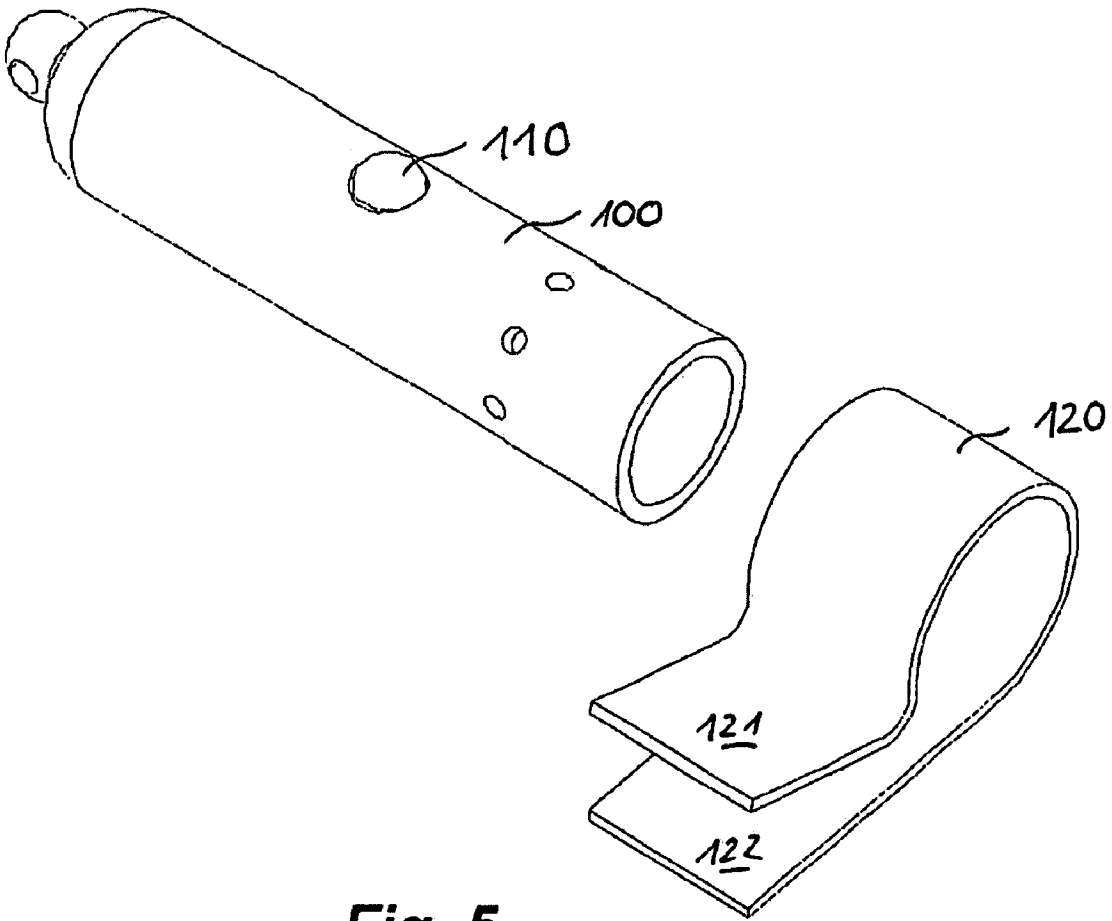
FIG. 5 is a perspective exploded view of a flashlight as well as of an elastic spring body.
Figure 6:
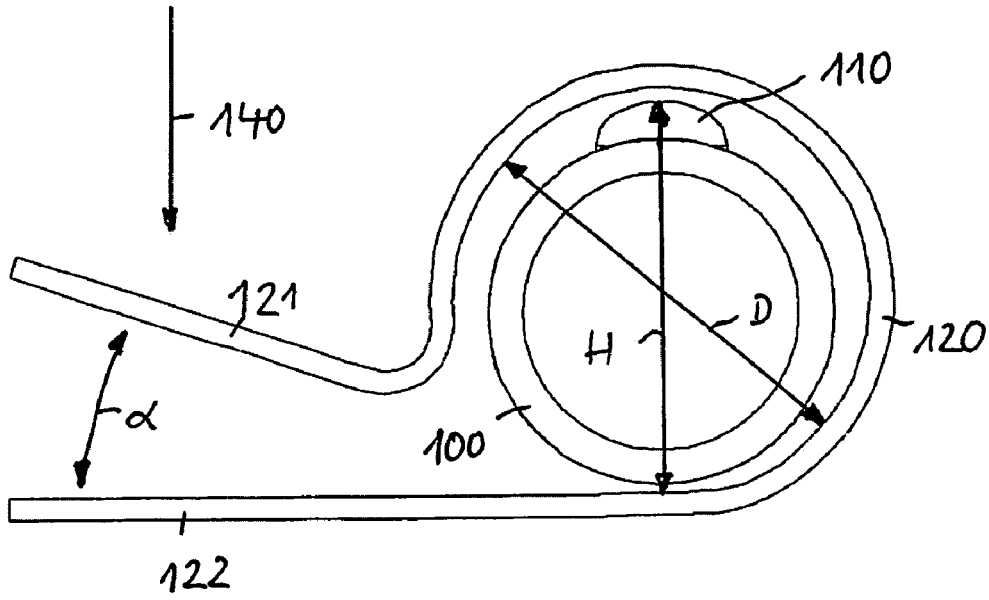
FIGS. 6 and 7 are cross-sectional views of the flashlight with the spring body in two operational positions.
Figure 7:
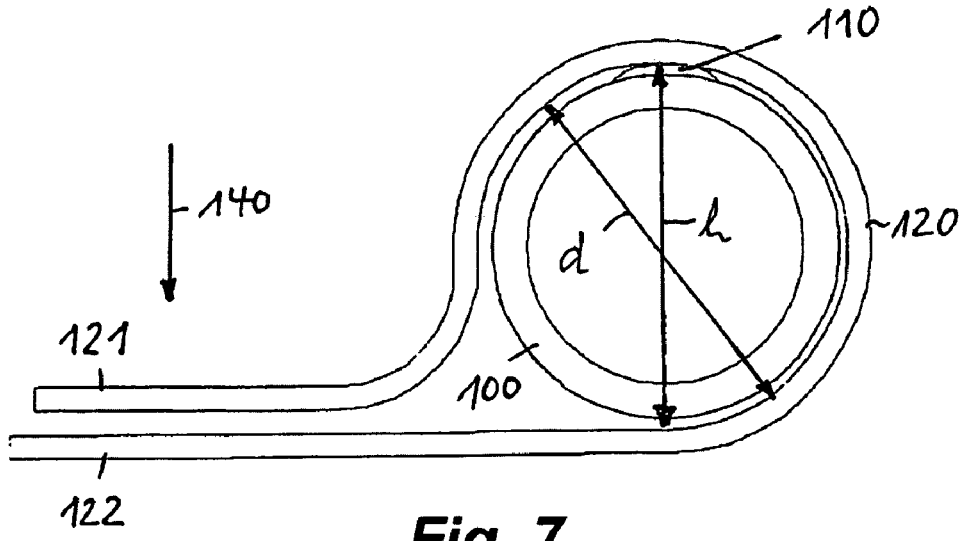
Figure 8:
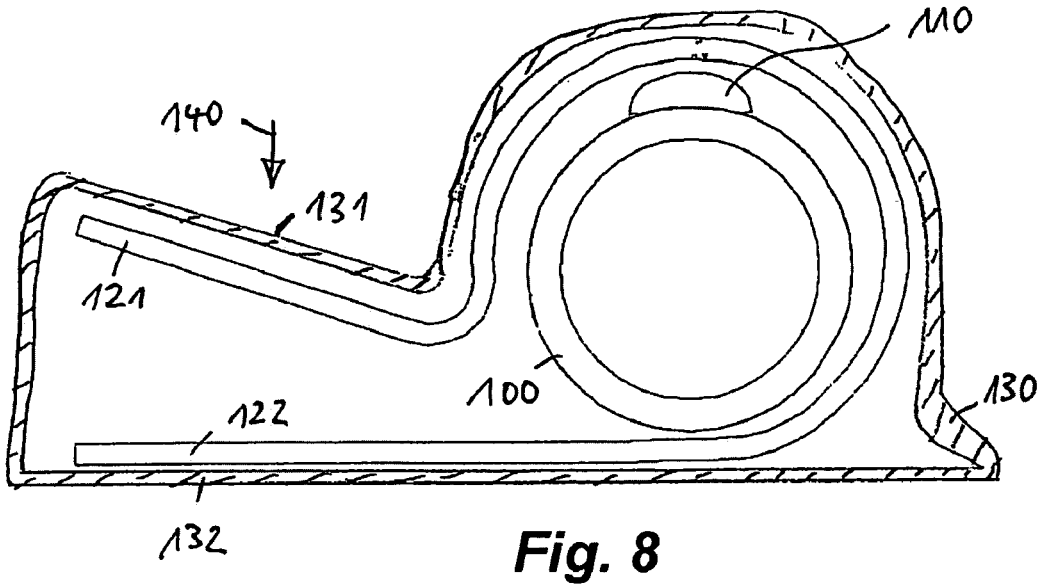
FIGS. 8 and 9 are cross-sectional views corresponding respectively to FIGS. 6 and 7 with additional packaging.
Figure 9:
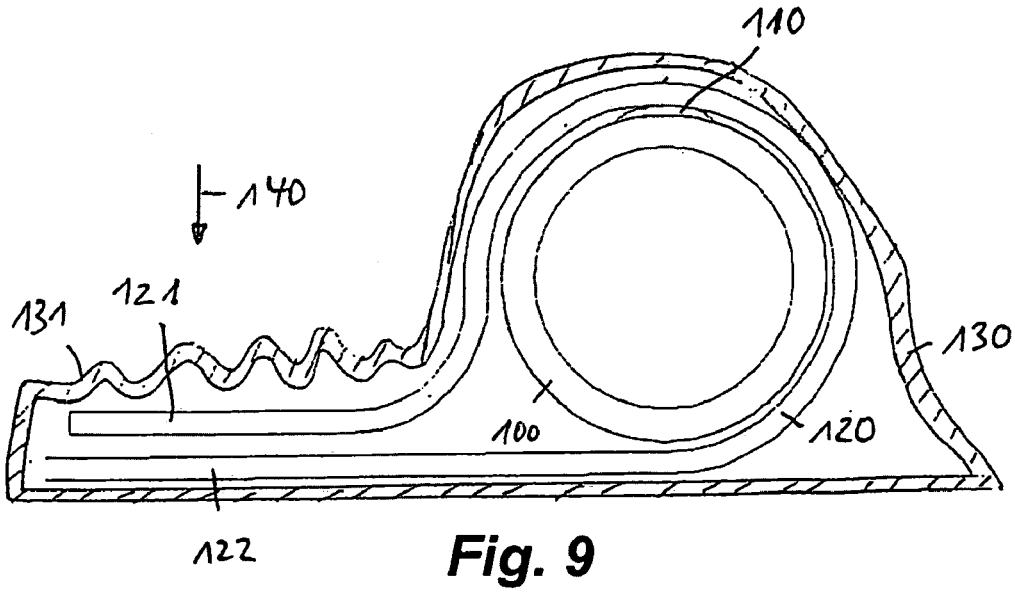

The flashlight 100 shown in FIG. 5 can have different sizes with flashlight lengths of 4 to 20 cm and more and correspondingly adapted small diameters, that is substantially determined by the diameter of the miniature battery cell that is used. The illustrated flashlight possesses on its housing a pressure switch 110 that can be partially depressed for switching on and off the lamp and contact closure and that only locks when further pushed in to lock contact closure or interrupt contact closure when pressed in all the way again. The flashlight 100 can be provided with light-emitting diodes as the light source or with an incandescent bulb. FIG. 5 further shows a shaped leaf spring in the relaxed state, that forms a circle or space of a maximal cylindrical housing whose diameter D is greater than the maximum distance H from the top of the pressure switch 110 to the diametrally opposite face of the flashlight 100. With such dimensions, the leaf spring 120 normally abuts as shown in FIG. 6 or 8 either without touching or touching without pressure around the flashlight body. This is in particular the case when the flashlight is provided in a package 130, e.g. a blister package. The leaf spring 120 has legs 121 and 122 that in the relaxed state are oriented at a sharp acute angle a to each other. By applying pressure in the direction of arrow 140 (the leg 122 being fixed), the leg 121 can be moved into the position shown in FIG. 7 against the spring force, such that the angle between the legs 121 and 122 is minimized or reduced to 0°. By this movement, even the largest enclosed circle is minimized to a diameter d (see FIG. 7) that is smaller than the distance represented in FIG. 6. As a result, the pressure switch 110 is pushed in and assumes the position shown in FIG. 7, in which the first part of its travel has been traversed for contact closure, so that the pushbutton function of the switch is used. The switch 110 however is not pushed in far enough to lock. The arrangement of the flashlight with a leaf spring that fits around the flashlight in the area of the pressure switch in a package 130, is shown in FIG. 8 where no force is applied in the direction of the arrow 140 on the leg 121. In the area indicated at 131, the packing foil is made flexible or even elastic, so that pressure in direction of the arrow 140 causes the leg 121 to shift in the direction of the leg 122 that is shown by the shape of the foil in the area 131 in FIG. 9. As described before with reference to FIG. 7, the pressure switch 110 can thus be partially actuated, so that the pushbutton function of this switch is used without locking it. This way, the flashlight does not have to be removed from the packing 130.

The above action is possible because the leg 122 or a back side 132 of the packing is fixed or abuts against a resistance. If this is not the case, a corresponding opposite force has to be applied on the back side 132 as well as on the leg 122 simultaneously with the force in the direction of the arrow 140, for moving both legs toward each other.

The above description relates to flashlights whose pressure switches are provided on the cylindrical housing. In a corresponding, but however not shown manner, the invention can also be applied to flashlights whose the pressure switch is provided on the back end opposite to the light output opening. In this case, a push element that is accessible from the outside for pushing in the pressure switch is provided in the described manner, this push element having to be moved against a spring load for pushing in the pressure switch. This can most simply be realized by the fact that the push element has a head against which is braced a helical spring whose other end bears on an abutment in the package or on the flashlight itself.

Figure 12:
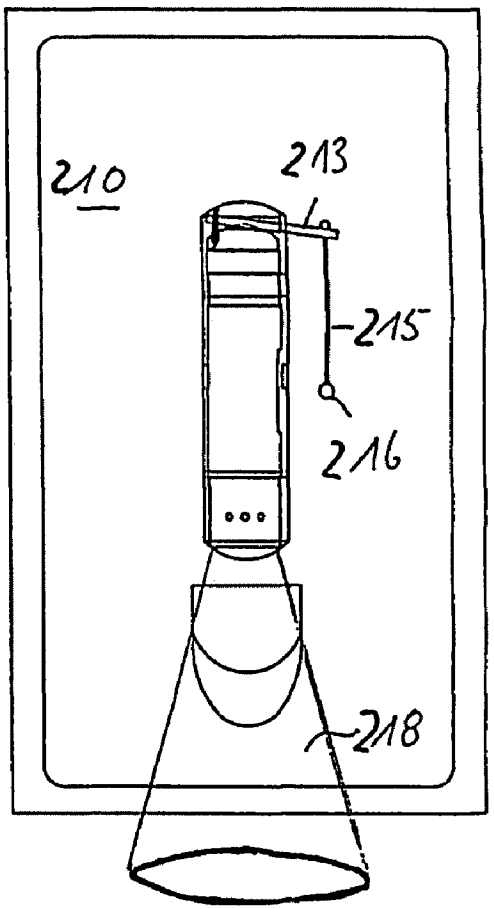
FIGS. 10 to 12 are a further embodiment of the invention.
Figure 11:
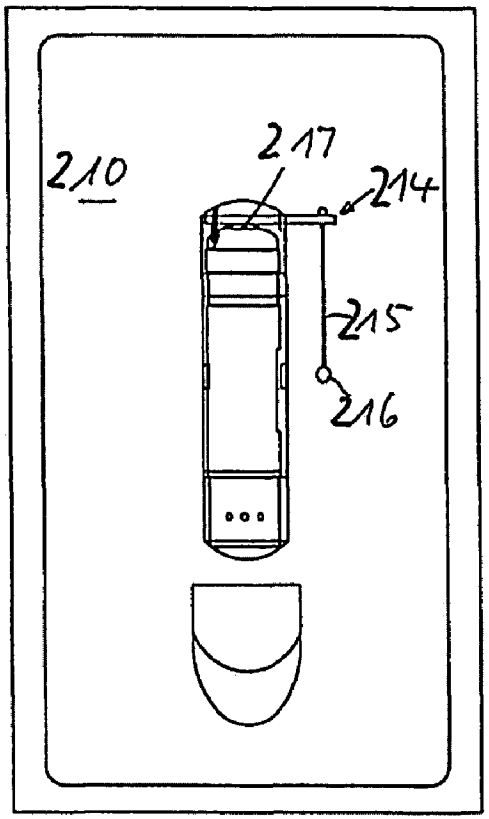
Figure 10:
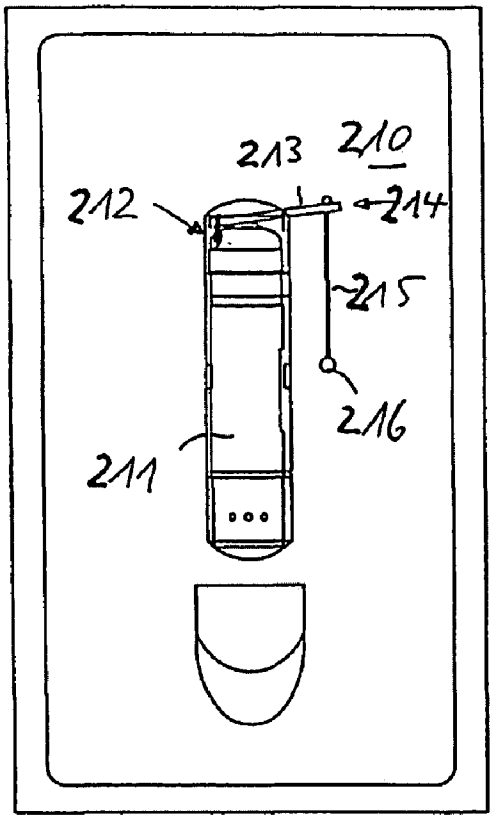

The variant shown in FIGS. 10 to 12 has a blister package 210 with a flashlight 211 that is fitted in a pocket. A triangular or circular body 212 through which the first end of a lever 213 is inserted and on the free end 214 of which a traction means 215 is attached is fitted to a loop of the flashlight, and its end 216 projects from the package. The customer is presented the package as in FIG. 10 and can by actuating the traction element 215 to the position shown in FIG. 11 move the lever 213 and thus the pressure switch 217 into the position according to FIG. 12. This way, the lever 213 is pivoted through a small acute angle so that it pushes in the pressure switch 217 to close the contacts in a closed electric circuit in the position shown in FIG. 12, in which the flashlight emits light that is shown by the light cone 218. By releasing the traction element 215, the lever 213 moved by spring force of the pressure switch 217 to pivot back into the starting position shown in FIG. 10, i.e. the closed circuit is opened.

At its simplest, the lever 213 is fitted to the loop with a triangle or a ring, so that the flashlight 211 can be removed and the lever 213 can be pushed out, the triangle or the ring 212 can be fitted with a hand loop or the like.

Figures 13, 14, 15, 16:
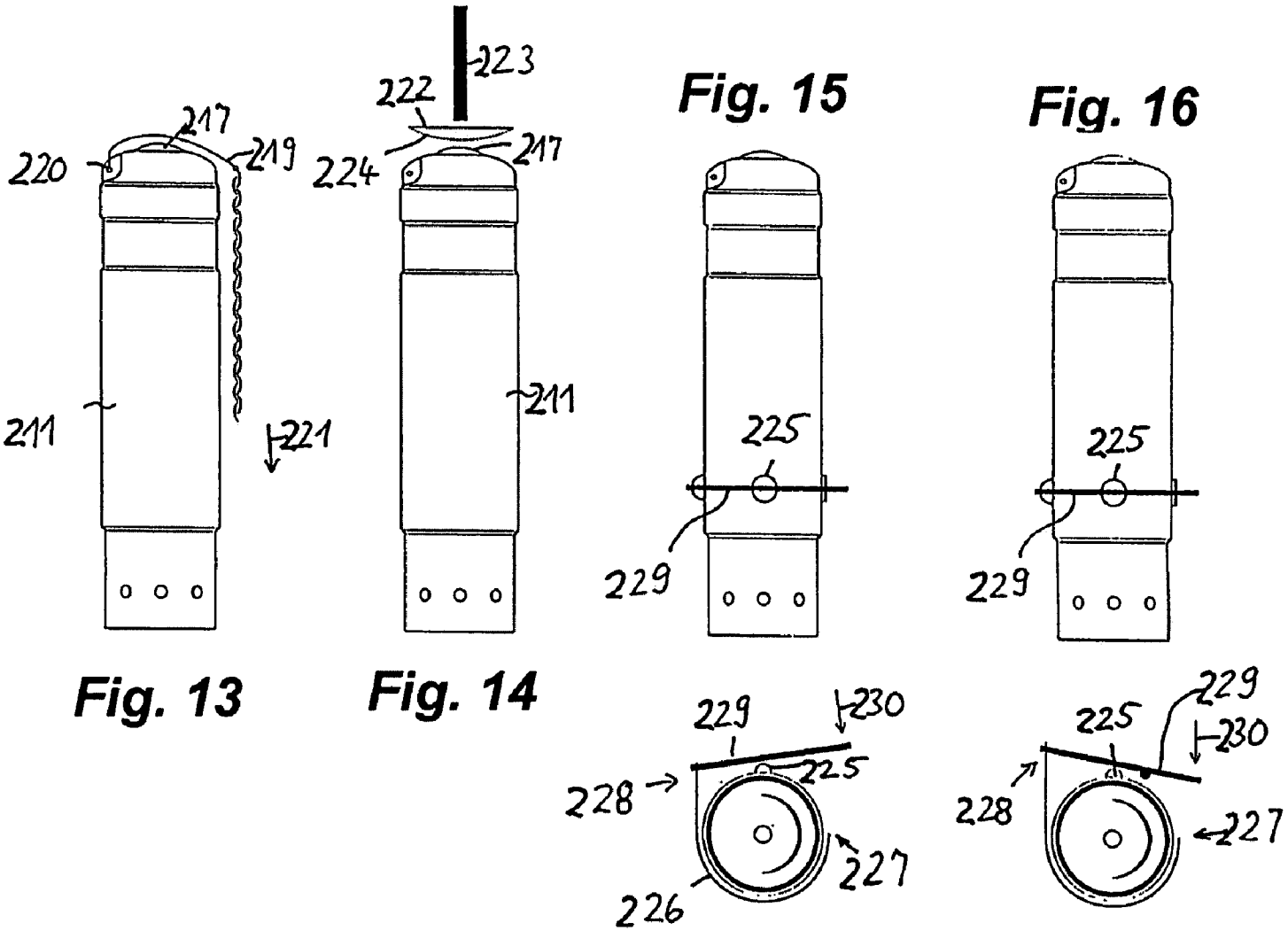
FIGS. 13 and 14 are views of alternative embodiments in which the actuating element consist of a cord or a rod that acts on the leaf spring.
FIGS. 15 to 19 are views of further embodiments.
Figure 17:
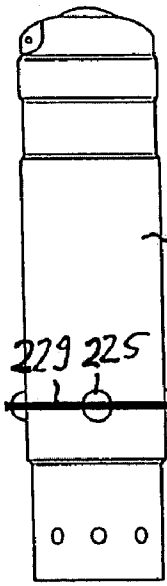
Figure 18:
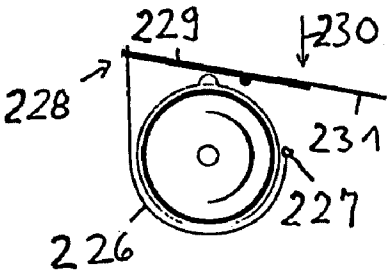

In FIG. 13, an embodiment is diagrammatically shown that also functions with a traction element, that is a cord 219. This cord 219 is attached with a loop 220 of the flashlight and passes over the pressure switch 217. If the cord is pulled in the direction of arrow 221, the pressure switch 217 is pushed in correspondingly until contacts are closed, but not locked. This can be assured by the fact that the point at which the locked position of the pressure switch is reached, is lower than that the pressure switch top must be moved pass, that is under the plane that is formed by the flashlight surface from which the pressure switch projects in the rest position.

In the variant shown in FIG. 14, in the (unillustrated) blister package, a leaf spring 222 is provided that can be shifted by a push rod 223, so that it can reach the position 224 and beyond tp even lower levels, in which the pressure switch 217 reaches the contact point for closing the electric circuit.

FIGS. 15 to 18 represent embodiments of the invention in which a pressure switch 225 that is provided in the cylindrical housing is activated. In these embodiments, a string 226 is attached with its first end 227 to the lamp 211 or the packing 210 (not shown here) and with its other end 228 to a rod or flat lever 229 that bears on the pressure switch 225 and that can be actuated by pressure in the direction of the arrow 230. This can be done either by finger pressure on the free end or by pressure on a plate 231 that is attached at the end, either the cited parts are exposed or the package in this area is flexible or elastic.

Figure 19:
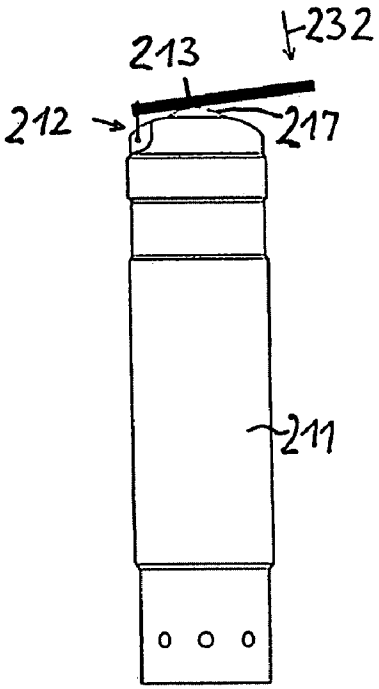

The activation mechanism according to FIG. 19 in turn corresponds to the construction according to FIGS. 10 to 12 with the difference that on the lever 213, no traction force, but a pressure force is applied in the direction of arrow 232.

Within the scope of the present invention, other pressure elements can be used that act directly on the pressure switch, but however it should then be provided that the pressure switch 217 not being pushed into the locked position. This can for example be assured by the pressure element having a front surface that s that is bigger than the diameter of the pressure switch that additionally only reaches the locked position for closing the electric circuit in a fixed manner in a position where its upper top lies below the housing surface that surrounds the switch.

Since the traction or pressure elements that serve for the external actuation of the lamp in the initial packaged state are not exposed to major permanent loads, inexpensive materials can be used. Preferably, these traction or pressure elements are made of plastic material, so that they can be provided in a recyclable manner together with the plastic package. Of course, only packages are used in which transparent openings for the light cone after switching on the lamp are provided. However, blister packages are preferably used that are made from transparent plastic foils that also permit showing the shape and design of the offered lamp.

The invention claimed is:

1. In combination with a flashlight having a housing, a battery in the housing, a light source on the housing, and a circuit between the battery and the light source and including a switch actuatable to energize the light source, a package comprising:

packaging material enclosing the flashlight;

an externally actuatable package switch separate from the housing switch and carried on the packaging material;

wiring connected between the package switch and the circuit of the flashlight such that the package switch is actuatable to energize the light source, the wiring connecting the package switch in parallel to the housing switch; and releasable means including a jack on the housing and a plug connected to the wiring and releasably engaged in the jack for connecting the wiring to the circuit for disconnection of the wiring and package switch from the circuit on separation of the flashlight from the package.

2. The combination defined in claim 1 wherein the packaging material wholly encloses the flashlight and must be destroyed to remove the flashlight from the package.

3. The combination defined in claim 1 wherein the package switch is a momentary-contact switch.

4. In combination with a flashlight having a housing, a battery in the housing, a light source on the housing, and a circuit between the battery and the light source and including a momentary-contact switch on the housing and depressible into a first position to energize the light source, a package comprising:

packaging material enclosing the flashlight and elastically deformable in a region of the switch; and an annular spring surrounding the housing inside the packaging material at the switch and elastically compressible through the packaging material to engage and depress the housing switch into only the first position.

5. The combination defined in claim 4 wherein the housing switch is depressible past the first position into a second position in which it locks and maintains a connection between the battery and the light source, the housing and spring being constructed such that the spring cannot depress the switch into the second position.

6. The combination defined in claim 4 wherein the spring surrounds the housing by more than 270°.

7. The combination defined in claim 4 wherein the spring has a pair of legs one of which is fixed in the packaging material and the other of which is movable in the packaging material between an outer position spaced from the one leg and in at most only light contact with the switch and an inner position engaging the one leg and depressing the switch into the first position.

8. In combination with a flashlight having a housing, a battery in the housing, a light source on the housing, and a circuit between the battery and the light source and including a momentary-contact switch on the housing and depressible into a first position to energize the light source, a package comprising:

packaging material enclosing the flashlight and elastically deformable in a region near the switch; and a string, lever, or rod extending between the packaging material and the switch, outside the housing, and actuatable by deflection of the packaging material in the region only to shift the switch into the first position.

9. The combination defined in claim 8, further comprising a leaf spring connected between the rod and the switch.

10. The combination defined in claim 8 wherein the lever is pivotal.

11. The combination defined in claim 8 wherein the switch is shiftable past the first position into a second position maintaining energization of the source from the battery, the switch being constructed such that repeated shifting into the second position disrupts the energization and turns off the source.

12. In combination with a flashlight having a housing, a battery in the housing, a light source on the housing having a light-output opening, and a circuit between the battery and the light source and including a momentary-contact switch on the housing and depressible into a first position to energize the light source and thereby project light from the opening, a package comprising:

packaging material enclosing the flashlight and elastically deformable region of the switch;

an externally actuatable package switch separate from the housing switch and carried on the packaging material;

wiring connected between the package switch and the circuit of the flashlight such that the package switch is actuatable to energize the light source; and means including a body pivotal relative to the housing in alignment with the light-output opening for deflecting, reflecting, or refracting light emitted by the source.

13. The combination defined in claim 12 wherein the packaging material has a transparent portion extending between the source and the body.

* * * * *